US005299706A

United States Patent [19]

Wardell, Jr.

[11] Patent Number: 5,299,706

[45] Date of Patent: Apr. 5, 1994

[54] PAIL LID

[75] Inventor: Myron H. Wardell, Jr., Lititz, Pa.

[73] Assignee: Cooper Industries, Inc., Houston, Tex.

[21] Appl. No.: 889,030

[22] Filed: May 26, 1992

[51] Int. Cl.[5] ..... B65D 41/46

[52] U.S. Cl. ..... 220/266; 220/277; 220/254; 220/265; 220/270

[58] Field of Search ..... 220/277, 254, 265, 266, 220/270

[56] References Cited

U.S. PATENT DOCUMENTS

| | | | |
|---|---|---|---|
| 2,533,355 | 12/1950 | Comfort | 220/254 X |
| 2,772,808 | 12/1956 | Fried | 220/277 |
| 3,084,835 | 4/1963 | Walsh | 220/265 X |
| 3,364,937 | 1/1968 | D'Amaro | 220/265 X |
| 3,737,066 | 6/1973 | Ames | 220/254 |
| 3,853,242 | 12/1974 | Zundel | 220/267 |
| 4,081,103 | 3/1978 | Zoellick | 220/254 |
| 4,084,723 | 4/1978 | Parker | 220/277 |
| 4,200,198 | 4/1980 | West | 220/269 |
| 4,460,103 | 7/1984 | Rama et al. | 220/254 |
| 5,201,419 | 4/1993 | Hayes | 206/409 |

*Primary Examiner*—Allan N. Shoap
*Assistant Examiner*—Vanessa Caretto
*Attorney, Agent, or Firm*—Nelson A. Blish; Eddie E. Scott

[57] ABSTRACT

An improved lid for a pail of the type in which chain or cordage is typically stored and shipped allows a user access to the chain or cordage within the pail without removing the entire lid and provides a means for retaining the end of the chain or cordage in an easily accessible position for the next user. The lid uses a uniquely shaped area of the lid defined by a perimeter of reduced thickness designed to be easily cut out or punched out with a hammer. The resulting hole allows easy hand access to the chain or cordage and has a notch at one side for hanging the loose end of the chain or cordage on for subsequent use.

8 Claims, 2 Drawing Sheets

PAIL LID

BACKGROUND

This invention relates to a novel improved lid for dispensing chain or cordage from a pail. The improved lid allows a user access to the chain or cordage within the pail without removing the entire lid and provides a means for retaining the end of the chain or cordage in an easily accessible position for the next user.

Chain or cordage is typically shipped to wholesalers and retailers in plastic containers or pails with a lid or top having a lip which secures to a rim on the pail. These lids are plastic also and are typically removed by making a series of vertical cuts in the lip of the lid at designated points molded in the lid. Once the lid is removed the entire contents of the pail are removed. This method is acceptable if the entire contents of the pail are to be used at once. Often however a retailer will sell only a few feet of the chain or cordage and wishes to keep the remaining chain or cordage in the pail and have the loose end of the chain or cordage accessible for the next customer.

Prior methods of dispensing the chain or cordage have required the lid to be removed as described above, fishing or threading the loose end of the remaining chain or cordage through a small opening in the lid, replacing the lid on the pail and tying the loose end of chain or cordage to prevent its falling back into the pail. The disadvantages of this method include the lid once cut as described above does not fit securely on the pail rim when replaced, and should the loose end of the chain or cordage fall into the pail the opening is too small to allow the customer to reach into the pail and retrieve the loose end without removing the lid. This method also requires the loose end of the chain or cordage to be retied after each use to prevent its falling into the pail. The present invention overcomes these problems by providing a novel lid for a pail with an easily removable opening in the lid which provides easy hand access to the chain or cordage without removing the lid and provides a convenient retainer for the loose end of the chain or cordage. With the novel lid, the customer is able to see the contents of the pail and is more likely to make a purchase than the prior art pail in which the customer often could not see the contents of the pail.

SUMMARY

An improved lid for a pail of the type in which chain or cordage is typically stored and shipped allows a user access to the chain or cordage within the pail without removing the entire lid and provides a means for retaining the end of the chain or cordage in an easily accessible position for the next user. The lid furthers provides an easy method of preparing the pail for display by the retailer. The lid uses a uniquely shaped area of the lid defined by a perimeter of reduced thickness designed to be easily cut out or punched out with a hammer. The resulting hole allows easy hand access to the chain or cordage and has a notch at one side for hanging the loose end of the chain or cordage on for subsequent use.

An object of the present invention is to provide an improved lid for a pail with a removable portion which allows access to chain, cordage or similar contents without removing the entire lid.

Another object of the present invention is to provide an improved lid for a pail which provides a retainer for the loose end of the chain or cordage to allow accessibility to the end by subsequent users.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENT

Figure 1:
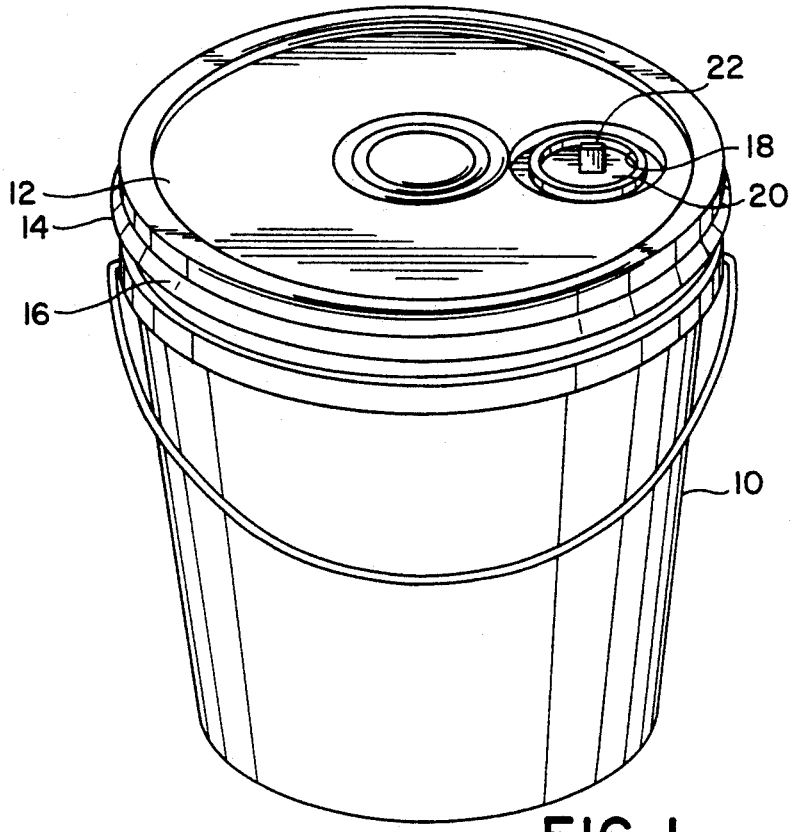
FIG. 1 (PRIOR ART)
FIG. 1 is an oblique view of a prior art chain or cordage pail.

A prior art pail 10 is shown in FIG. 1. The pail 10 is closed with lid 12 which is secured to pail 10 by rim 14 in a manner well known to those skilled in the art. Removal of lid 12 requires a series of vertical cuts 16 be made in rim 14 equally spaced around the circumference. Lid 12 has access port 18 radially disposed thereon with pop out plug 20 therein. The preferred method of use for this lid configuration is to remove plug 20 by pulling on tab 22 with a pair of pliers, remove lid 12 by making the series of cuts 16 discussed above, remove lid 12, feed the loose end of the chain or cordage through the access port 18, replace lid 12 and tie the end of the chain or cordage with a cord to prevent the chain or cordage from falling back into the pail 10.

Figure 2:
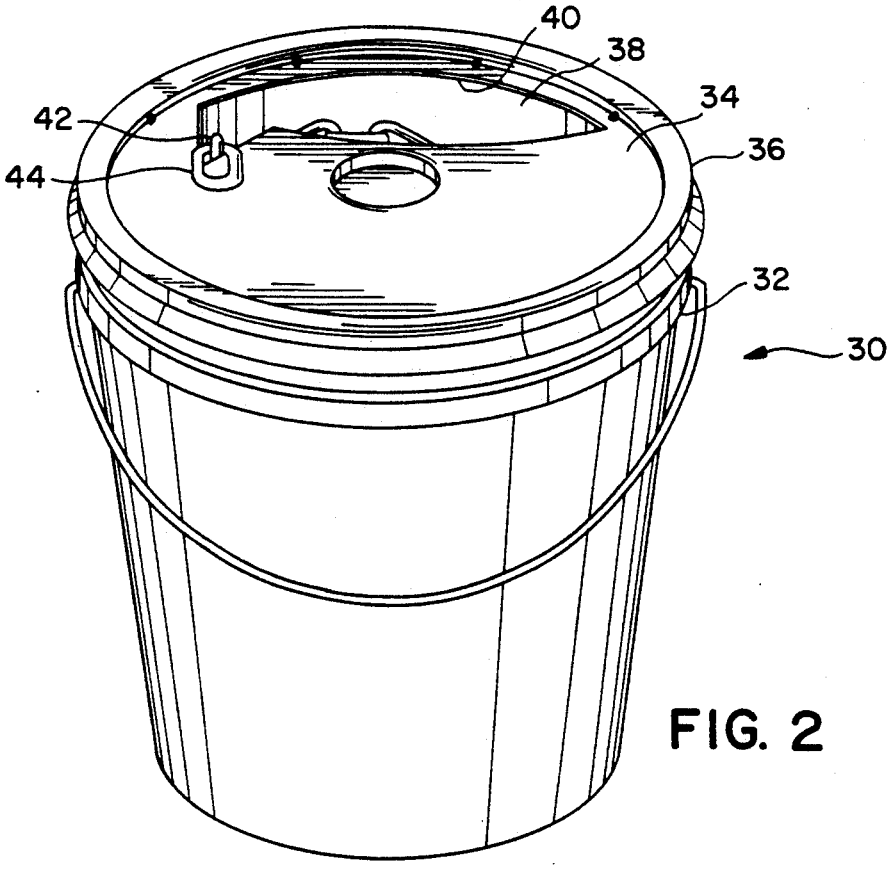
FIG. 2 is an oblique view of the chain or cordage pail lid of the present invention with the removable portion of the lid removed and the end of a chain retained in a notch.

The improved pail and lid of applicant's invention, denoted generally by numeral 30, is best seen in FIG. 2. Applicant's invention includes pail 32 of conventional configuration and improved pail lid 34, also known as a cover or top, to those skilled in the art. Pail lid 34 includes upstanding rim 36 which secures lid 34 to pail 32 in a manner well known to those skilled in the art. Lid 34 includes a removable area or panel 38 defined by a perimeter 40 of reduced thickness with notched portion 42 disposed at one end of removable area 38.

The shape of removable area 38 is best described as that of the overlapping or intersecting area of two circles of differing radii with notch 42 formed at one end. Notch 42 is of a suitable shape to retain the chain 44 in cover 34, such as "U" shaped or "V" shaped as shown. This shape allows human access to chain 44 in the pail 32 without requiring removal of cover or top 34 as described above in the prior art pail. Additionally, notch 42 provides a retainer for holding the end of the chain 44 after each use. In the event a user should drop the end of the chain 44 into the pail, removable area 38 is sufficiently large to allow a user to retrieve the end of the chain without having to remove the top 34.

Figure 3:
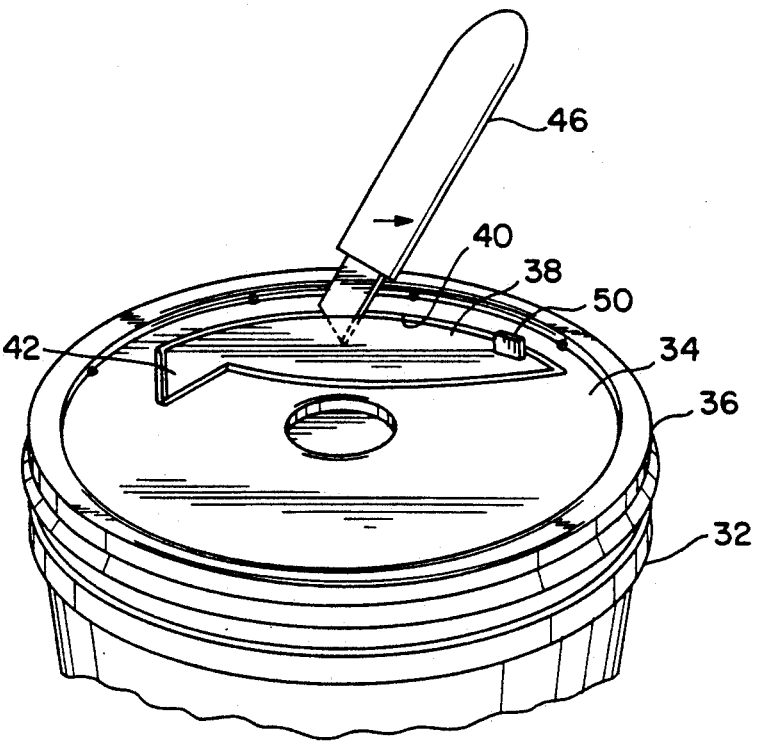
FIG. 3 is an oblique view of the lid showing the removable portion of the lid being removed with a knife.
Figure 4:
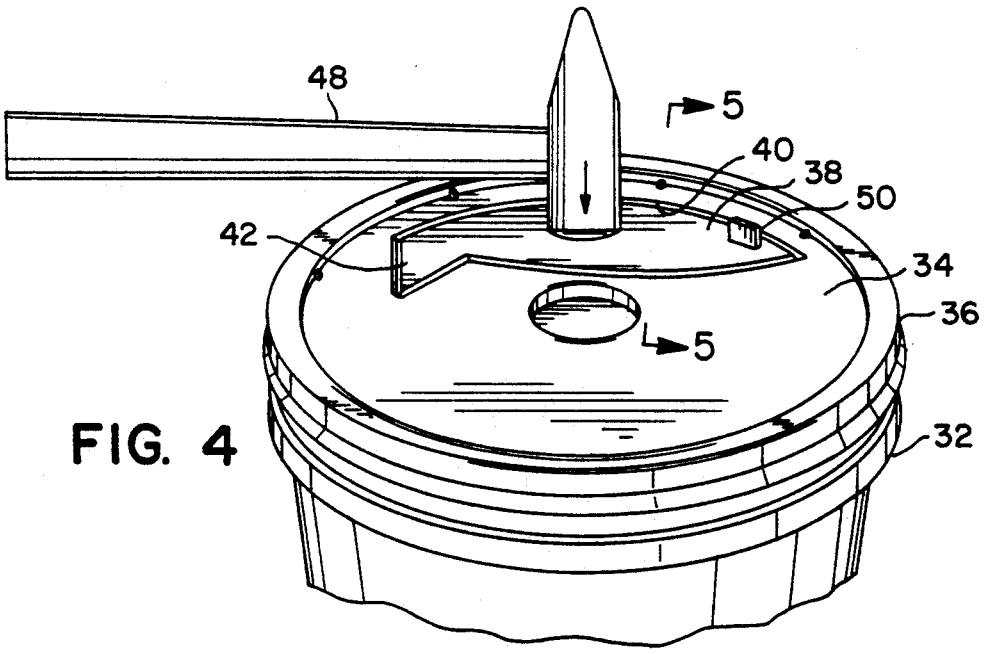
FIG. 4 is an oblique view of the lid showing the removable portion of the lid being removed with a hammer.
Figure 5:
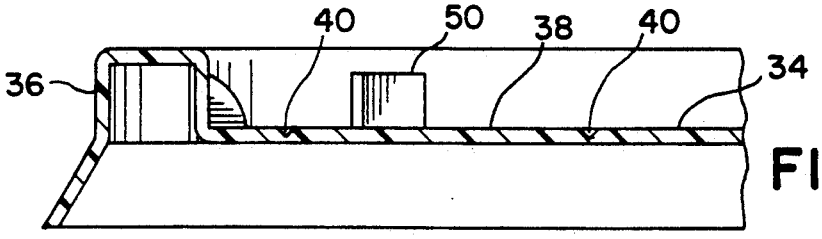
FIG. 5 is an sectional view through the lid showing the reduced thickness perimeter of the removable section of the lid.

As best seen in FIG. 5, the reduced thickness perimeter 40 may be formed by "scoring" the surface of the lid 34, by perforation or most preferably, may be formed by the molding process of the lid 34 as in the embodiment shown. With this reduced thickness perimeter 40, a user only need use a knife 46 to cut along perimeter 40 as best seen in FIG. 3 to allow removal of area 38. Alternatively, a user may knock out area 38 along reduced thickness perimeter 40 with a few taps by hammer 48 as shown in FIG. 4. Additionally, a pair of pliers may be used to grasp tab 50 on area 38 to assist the user in removing area 38 by tearing along reduced thickness outline 40.

The construction of my improved pail lid and the methods of its application will be readily understood from the foregoing description and it will be seen I have provided an improved lid for a pail of the type in which chain or cordage is typically stored and shipped which allows a user access to the chain or cordage within the pail without removing the entire lid and provides a means for retaining the end of the chain or cordage in an easily accessible position for the next user. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. A lid for a pail, comprising:

a cover with an upstanding rim, an area of said cover defined by a periphery of reduced thickness to facilitate removal of said area, said removable area including a notched portion for holding the end of a chain or cordage in a readily accessible position in the lid wherein removal of said removable area allows access to said chain or cordage within said pail without removal of said lid from said pail, and said removable area is substantially in the shape of a pair of arcuate segments with concave sides facing each other, one of said segments being shorter in length than said other segment, each segment having a pair of ends, an end of each segment intersecting, and the other end of each respective segment being spaced apart and interconected by said notched portion.

2. A lid for a pail according to claim 1 wherein said notched portion is a substantially "V" shape.

3. A lid for dispensing chain or cordage from a pail, comprising:

a top affixed to a pail, said top including a notch for holding the end of a chain or cordage in a readily accessible position, a removable panel in said top with a perimeter of reduced thickness to aid removal of said removable panel, and said removable panel substantially in the shape of a pair of arcuate segments with concave sides facing each other, one of said segments being shorter in length than said other segment, each segment having a pair of ends, an end of each segment intersecting, and the other end of each respective segment being spaced apart and interconnected by said notch.

4. A lid for dispensing chain or cordage from a pail according to claim 3 wherein removal of said removable panel allows a user access to said chain or cordage within said pail without removal of said top from said pail.

5. A lid for dispensing chain or cordage from a pail according to claim 4 wherein said notch is a substantially "V" shape.

6. A lid for dispensing chain or cordage from a pail according to claim 5 wherein said notch is substantially U shaped and is sized to retain a link of a chain.

7. A lid for dispensing chain or cordage from a pail according to claim 6 wherein said removable panel further includes a tab disposed thereon to facilitate removal to said removable panel.

8. A lid for dispensing chain or cordage from a pail according to claim 5 wherein said removable panel further includes a tab disposed thereon to facilitate removal of said removable panel.

* * * * *